United States Patent [19]

Logan, Jr. et al.

[11] Patent Number: 4,489,308

[45] Date of Patent: Dec. 18, 1984

[54] EMERGENCY EXIT INDICATORS

[76] Inventors: Emanuel L. Logan, Jr., 2301 Jefferson Davis Hwy., Arlington, Va. 22202; J. William Walsh, 3823 Beech Ave., Baltimore, Md. 42111

[21] Appl. No.: 463,596

[22] Filed: Feb. 3, 1983

Related U.S. Application Data

[63] Continuation-in-part of Ser. No. 244,686, Mar. 3, 1981, abandoned.

[51] Int. Cl.[3] ..... G08B 17/00; G08B 5/38

[52] U.S. Cl. ..... 340/286 R; 191/12.2 A; 242/54 R; 254/345; 254/362; 340/331; 340/628; 340/815.29

[58] Field of Search ..... 340/286 R, 286 T, 815.29, 340/331, 628; 116/5; 191/12.4, 12.2 A; 339/5 RL, 6 RL, 8 RL; 242/54 R, 85; 254/345, 362

[56] References Cited

U.S. PATENT DOCUMENTS

| | | | |
|---|---|---|---|
| 466,509 | 1/1892 | Painter | 339/8 RL |
| 1,469,946 | 10/1923 | Morrison | 340/333 |
| 2,518,979 | 8/1950 | Davidson | 340/815.29 |
| 2,705,791 | 4/1955 | Merancy | 340/399 X |
| 3,916,404 | 10/1975 | Gouge | 340/332 X |
| 4,148,023 | 4/1979 | Elkin | 340/628 |

*Primary Examiner*—James L. Rowland
*Assistant Examiner*—Daniel Myer
*Attorney, Agent, or Firm*—John R. Moses

[57] ABSTRACT

A system for identifying emergency exits in a building includes a strobe light which is tethered at an elevated location with respect to the floor of the building. The strobe light is normally held at the elevated position by an electromagnet, which electromagnet is kept energized as long as a smoke detector connected thereto does not sense a dangerous level of smoke. As soon as the smoke detector detects smoke above a certain threshold level, the electromagnet is deenergized and the strobe light drops to a position suspended just above the floor. The strobe light includes its own battery source which is connected to the strobe light by a switch which closes when the strobe light is dropped. An electric motor is provided to rewind the tether when the smoke detector no longer indicates an emergency situation. By tethering the strobe light, the light can be dropped beneath the smoke level in the building, allowing people crawling along the floor to determine the location of emergency exits.

9 Claims, 5 Drawing Figures

EMERGENCY EXIT INDICATORS

This application is a continuation-in-part of U.S. Pat. application Ser. No. 244,686 filed Mar. 3, 1981, in the name of Emanuel L. Logan, Jr. now abandoned.

BACKGOUND OF THE INVENTION

1. Field of the Invention

This invention relates to emergency exit indicators, and more particularly, this invention relates to emergency exit lights configured to function only upon the occurrence of an emergency situation.

2. General Considerations and Prior Art

Exits from a building are normally marked with illuminated "EXIT" signs. These signs are mounted above emergency exits in order to be visible by those who might use the exits. Unfortunately, the exit signs can become obscured by smoke which first rises and then accumulates down from the ceiling of a room or a hall. In order to avoid this, people are advised to stay low when trying to escape from a burning building, and, if necessary, to crawl along the floor. While crawling along a floor, it is often difficult to determine the location of an emergency exit. Frequently, fires interrupt power to a building so that emergency exit signs and lights are extinguished resulting in great confusion to anyone who is trying to escape. In addition, the glow of a red light distorted by smoke can resemble fire and cause a person trying to escape to move away from the exit.

In view of the aforementioned considerations, there is a need for emergency exit devices which are effective in conveying to people the location of emergency exits when a room or building is filled with smoke.

SUMMARY OF THE INVENTION

It is a feature of the instant invention to provide a new and improved emergency exit device, the function of which is not defeated by smoke or a power failure in a building.

In view of this feature, the instant invention contemplates a system which uses, in combination, a device for detecting an emergency condition and providing an emergency signal. The signal is used to release an indicating light that drops from an elevated position to a position relatively close to the floor of the building.

The instant invention further contemplates utilizing a battery with the light so that the light need not depend on line current in the building for power.

In accordance with still another specific embodiment of the invention, the invention includes a device, such as an electric motor, which raises the light automatically and a switch which cuts off the light when the emergency condition ends. This allows the system to be tested whenever desired.

DESCRIPTION OF THE PREFERRED EMBODIMENT

Figure 1:
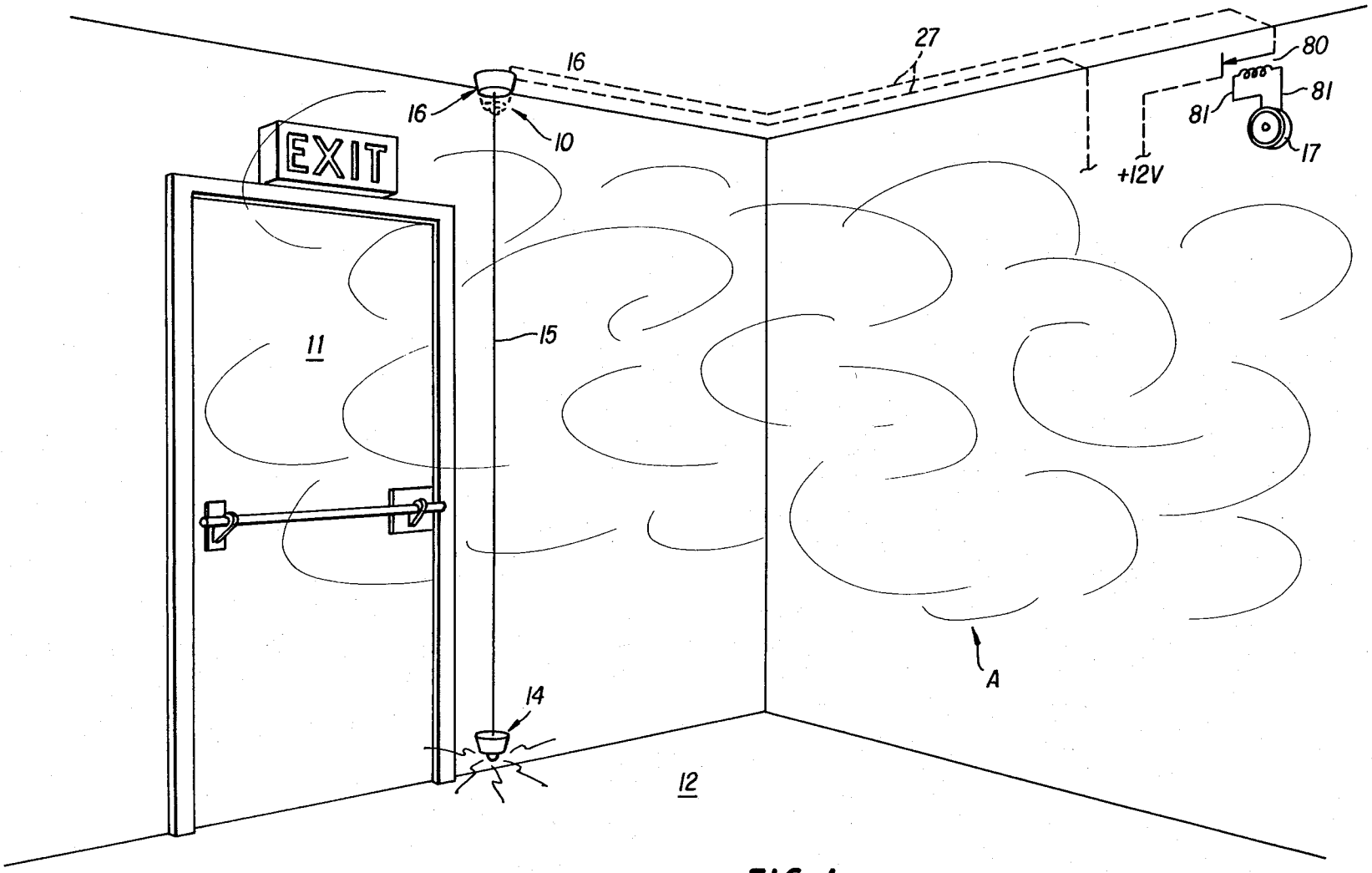
FIG. 1 is a pictorial view of an emergency exit indicating system according to the instant invention.

Referring now to FIG. 1, there is shown an emergency condition indicating system, designated generally by the numeral 10, which is mounted adjacent to an emergency exit 11 at a relatively high level above the floor 12 of the building or enclosure having the emergency exit.

The system 10 includes a strobe light module, designated generally by the numeral 14, which is connected by a tether 15 to a mounting module, designated generally by the numeral 16. Under ordinary circumstances, the strobe light module 14 remains positioned adjacent to the mounting module 16 (as is shown in dotted lines). However, as seen in FIG. 1, upon the occurrence of an emergency condition, such as a fire, the strobe module light 14 drops down near the floor 12 so as to be beneath any smoke A accumulating in the enclosure. The fall of the strobe module 14 is terminated by the tether 15. Preferably, a conventional smoke detector 17 is used to sense smoke in the enclosure, and upon smoke being sensed, the mounting module 16 releases the strobe light module 14 to fall beneath the level of the smoke.

Figure 2:
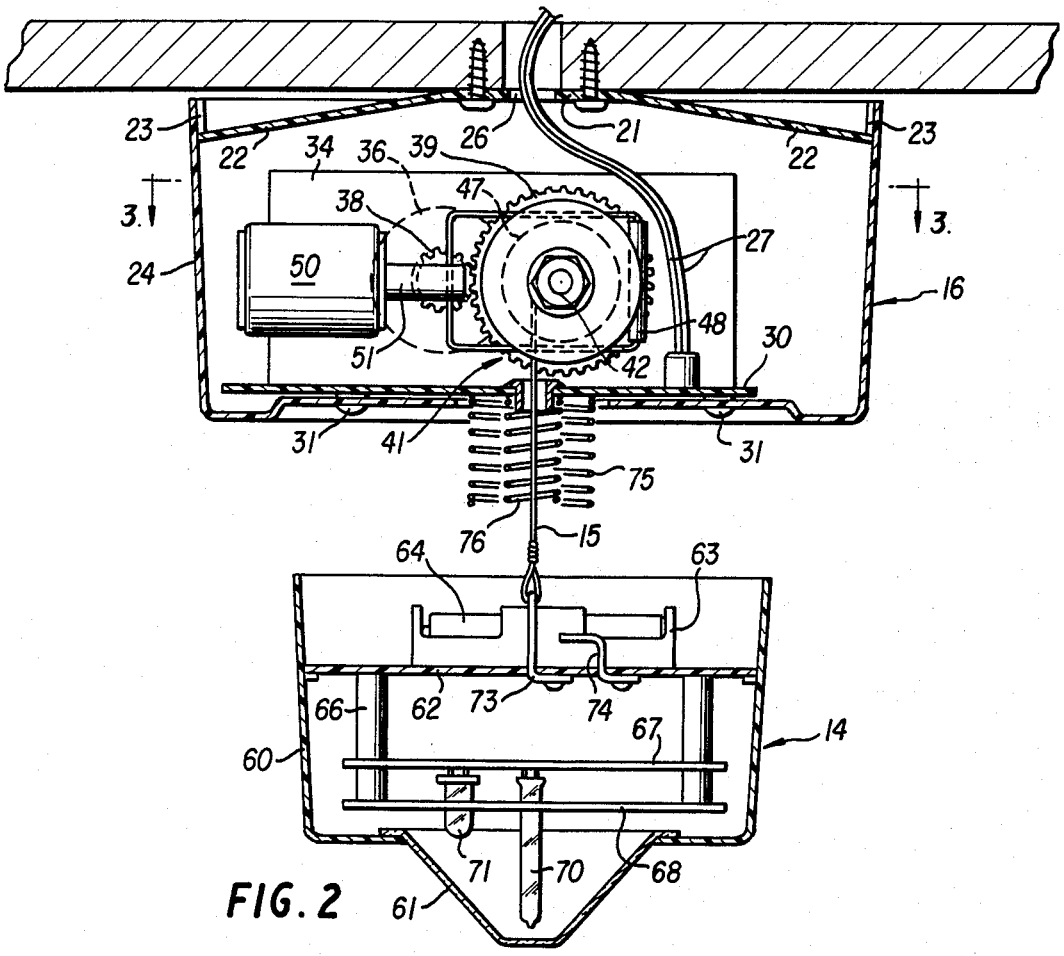
FIG. 2 is a side elevation showing both a mounting module and strobe light module in section.
Figure 3:
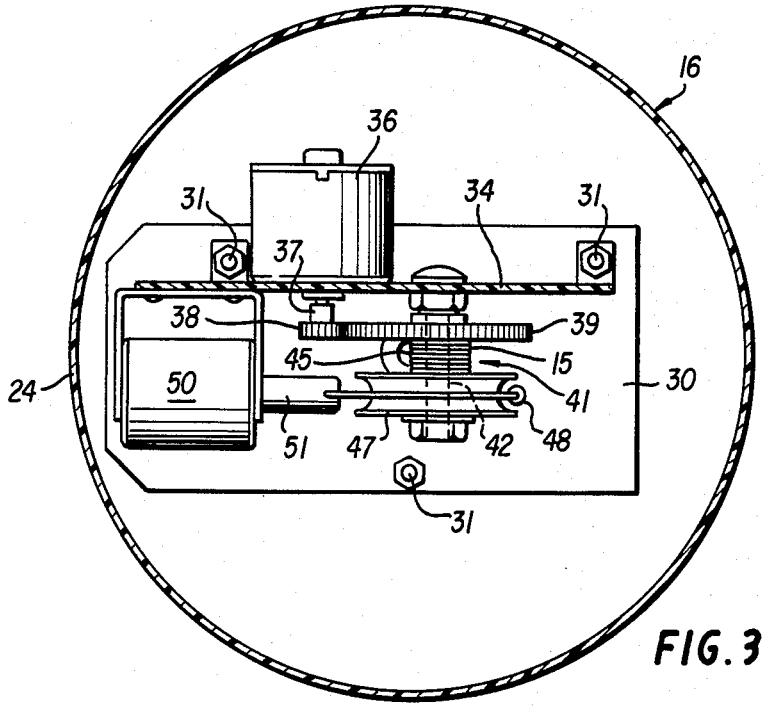
FIG. 3 is a top elevation taken along Line 3—3 of FIG. 2 showing the workings of the mounting module.
Figure 4:
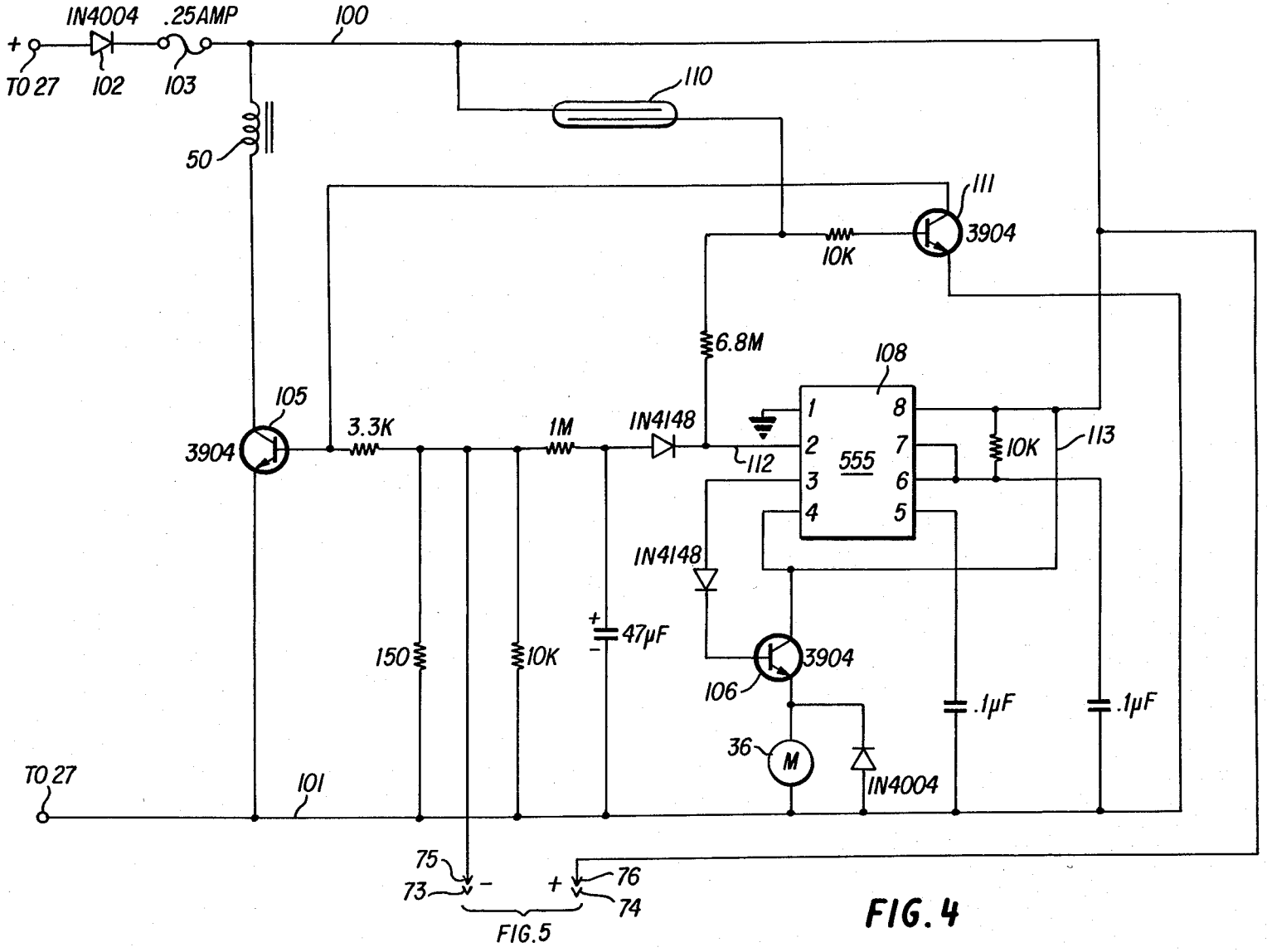
FIG. 4 is a circuit diagram showing the circuitry within the mounting module.

Referring now to FIGS. 2 and 3 wherein the structure of the emergency indicating system 10 is shown in more detail, the mounting module 16 is itself mounted on a ceiling mounting plate 21, which mounting plate is secured to the ceiling and has flanges 22 thereon which fit beneath lugs 23 on a housing 24 which encloses the workings of the mounting module 16. The mounting plate 21 has an opening 26 through which leads 27 that energize the workings of the mounting module 16 pass. A printed circuit board 30 is secured within the mounting module 24 by screws 31 which pass through housing 24. The various circuit components shown in FIG. 4 are mounted on the printed circuit board 30. A mounting flange 34 is secured to and projects vertically from the printed circuit board 30. An electric motor 36 is mounted on the flange 34. The electric motor 36 has a drive shaft 37 extending therefrom which rotates a pinion 38. The pinion 38 meshes with a drive gear 39 on a spool, designated generally by the numeral 41, which is journalled by an axle 42 in the mounting plate 34. The spool 41 includes a reel 45 and a brake drum 47 which is selectively engaged by a brake band 48. The brake band 48 is brought into frictional engagement with the brake drum 47 by energizing a solenoid 50 which is connected to the brake band 48 via an armature 51. The tether 15 is secured to the reel 45 and is wound on the reel by energizing the motor 36 so as to raise and lower the strobe light module 14.

The strobe light module 14 includes a housing 60, which encloses the workings of the strobe light module, a lens 61, and a supporting plate 62 to which the tether 15 is attached (via contact 74). The supporting plate 62 also includes mounting brackets 63 for a pair of batteries 64 (only one is shown) which are connected in series to energize the strobe light. Sleeve screws 66 extend down from the mounting plate 62 and pass through a printed circuit board 67 which is, in turn, secured in spaced relation to a bottom plate 68. The printed circuit board 67 mounts the circuitry of FIG. 5 which drives the strobe, which in this case is a Zenon flask tube 70. A LED 71 provides an indication that the batteries 64 are charged.

In the preferred embodiment, a pair of contacts 73 and 74 on the strobe light module 14 engage light coil spring contacts 75 and 76, respectively, on the mounting module 16 in order to inform the mounting module when the strobe light module is in the retracted position.

In operation, the solenoid 50 remains energized as long as there is power on leads 27. When power to the leads 27 is interrupted, the solenoid releases the brake band 48 from the brake drum 47, allowing the strobe light 14 to drop via the tether 15. If the leads 27 are thereafter energized, the motor 36 will rotate the spool 41 to reel the tether 15 back onto the reel 45. When the contacts 73 and 74 contact the spring contacts 75 and 76, the solenoid 50 is reenergized to engage the brake band 48 with the brake wheel 47. After a short delay of about one-half second, power to the motor 36 is cut.

The leads 27 are connected to a drop out relay 80 which is normally closed until there is current on lines 81, which are connected to an alarm system or smoke detector 17. Upon the occurrence of an alarm condition, current flowing in lines 81 causes the drop out relay 80 to open which opens the leads 27 and de-energizes the solenoid 50.

FIG. 4 shows the circuitry of the mounting module 16, which circuitry, for the most part, is mounted on printed circuit board 30. Leads 27 are attached to line 100 and return line 101 and apply current through a diode 102 and quarter-amp. fuse 103. The current energizes the solenoid 50 which holds the strobe light module 14 up by restraining rotation of the reel 45 through operating brake band 48 (see FIG. 2). When the 12-volt supply to the solenoid 50 is interrupted upon the occurrence of an emergency, the solenoid releases the reel 45 and allows the strobe light module 14 to drop. Upon termination of the emergency, the lines 100 and 101 are re-energized and the motor 36 is turned on which rewinds the tether 15 on the reel 45. When the contacts 73 and 74 close with the contacts 75 and 76, the solenoid 50 is re-energized by switching on a transistor 105, and the motor 36 de-energized by switching off a transistor 106. A timing circuit in the chip 108 causes the solenoid to be energized about one-half second before the motor 36 shuts off to make sure that the strobe light module 14 does not slip back down before being stopped by the friction band 48.

In order to test the unit, a reed switch 110 is provided in the upper module circuit. All one need do is to place a magnet in juxtaposition with the reed switch 110 to turn on a transistor 111 which pulls the base of transistor 105 to ground, thereby cutting power to the solenoid 50 and allowing the strobe light module 14 to drop. During the test, line 112, which is connected to pin 2 of the logic circuit timer 108, goes high, which causes pin 3 to go low in order to insure that the transistor 106 will keep power to the motor 36 off even though power is on lines 100 and 101. When the magnet is moved away from the reed switch 110, pin 3 goes high, which switches on transistor 106 and energizes the motor 36 via line 113 which is connected to line 100. Upon contact 73 closing with contact 75 and contact 74 closing with contact 76, line 112 again goes high causing pin 3 to go low so as to cause transistor 106 to cut power to the motor 36 subsequent to re-energizing solenoid 50.

Figure 5:
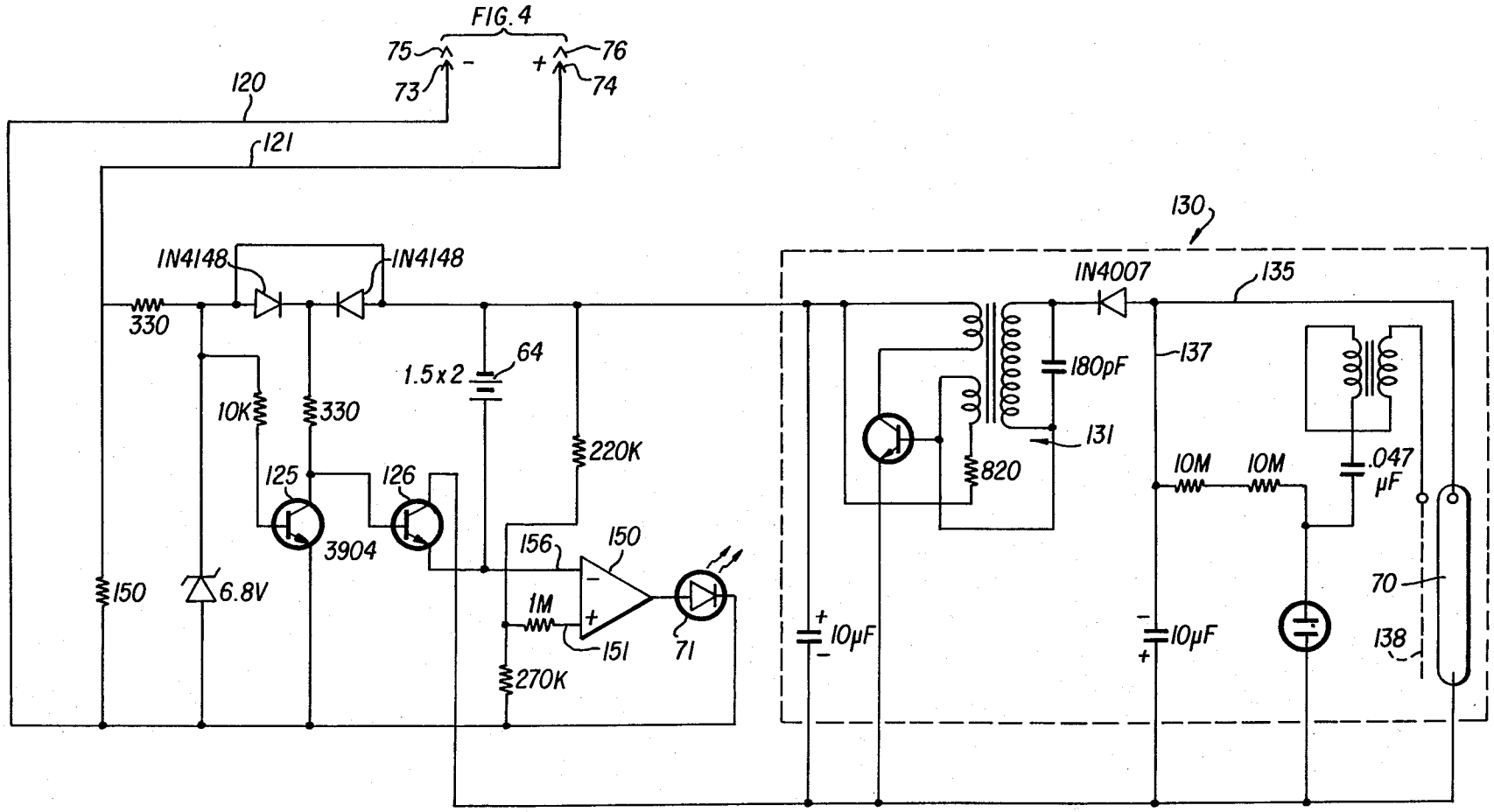
FIG. 5 is a circuit diagram showing the circuitry within the strobe light module.

Referring now to FIG. 5, where the circuitry for the strobe light module 14 is shown, which circuitry is for the most part mounted on the printed board 67 (FIG. 2), the contacts 73 and 74 are connected by lines 120 and 121 to a 150-ohm resistor which applies a 150-ohm resistance across the lines connected to contacts 75 and 76, as long as the contacts 73 and 74 are engaged with contacts 75 and 76. When the strobe light module 14 drops away, contact is broken between the set of contacts 73 and 74 and the set of contacts 75 and 76. This causes driver transistor 125 to turn on power transistor 126 which allows current to flow from the batteries 64 to the zenon flash tube 70. A conventional flasher circuit, designated generally by the numeral 130, is used to strobe the zenon flash tube 70. The circuit shown is similar to that utilized to operate the ARCHER strobe light (Catalog No. 61-2644)available from the Radio Shack Division of the Tandy Corporation, Fort Worth, Texas, 76102.

The strobe light circuit 130 operates substantially as follows. An oscillator, designated generally by the numeral 131, boosts the three-volt output of batteries 64 to 300 volts D.C. which is delivered over line 135 to the zenon flash tube 70. A trigger circuit 136 boosts the 300-volt potential on line 137 to 3,000 volts and applies this 3,000-volt potential periodically to trigger 138, which periodically interrupts ignition in the zenon flash tube, causing the flash tube to flash at a selected interval. In the disclosed embodiment, the preferred interval is two seconds. Accordingly, when the lower strobe light module 14 falls away from the mounting module, the zenon flash tube 70 will flash at a position adjacent the floor. With two 1.5-volt batteries the flash tube will continue to flash for at least eight hours when fresh alkaline batteries are used.

When power is restored to the lines 100 and 101 (FIG. 5) energizing the motor 36, the strobe light module 14 is returned to its position adjacent the mounting module 16 which closes the set of contacts 73 and 74 with the set of contacts 75 and 76. This causes the transistor 125 to cut off transistor 126 which, in turn, switches off the zenon flash tube 70.

In order to determine whether or not the batteries 64 have sufficient charge to operate the strobe circuitry 130, the LED 71 is connected to the output of an operational amplifier 150 which has a first input 151 connected across lines 120 and 121 via line 153 and a second input 156 connected to the batteries 64 via line 157. The operational amplifier serves as a comparator and keeps the LED 71 lit as long as the voltage output of the batteries 64 is greater than 2.4 volts. If the voltage of the batteries drops below 2.4 volts, the LED is extinguished. Power for lighting the LED 71 is provided by power on lines 120 and 121 which lines are energized by the voltage continually applied to lines 100 and 101 of the mounting module 16.

The instant invention provides a relatively simple inexpensive device for marking emergency exits 11 wherein emergency exits are visible even after an enclosure is substantially filled with smoke. This is because the strobe light 14 drops beneath the smoke and reflects off of the floor 12, walls and bottom surface of the smoke layer A so as to still be visible by people seeking to escape from the enclosure by crawling beneath the smoke. Since the exit marker according to the instant invention utilizes its own electrical power obtained from the battery 70, the strobe light 14 will function even when electrical power in the building has been interrupted. Accordingly, a new and improved emergency exit marking system 10 is provided which increases the chances of people escaping from a fire within a building.

What is claimed is:

1. In combination with an enclosure having an emergency exit having a top and a bottom, a floor adjacent to the bottom of the exit and a ceiling adjacent to the top of the exit; a system for identifying the emergency exit in the enclosure to a person in the room when the enclosure becomes partially filled with smoke accumulated from the ceiling down to a level spaced from the floor defining a relatively smoke free space, the combination comprising:

detecting means for detecting the occurrence of a fire;

emergency signal-generating means connected to the detecting means for generating an emergency signal upon the occurrence of a fire;

indicating means installed in juxtaposition with the exit, the indicating means including: mounting means for mounting the indicating means in the enclosure at a level spaced from the floor and adjacent to the top of the exit, a tether having first and second ends and being secured to the mounting means at the first end, the tether having a length sufficient to extend from the mounting means to a position within the relatively smoke free space proximate the floor, light means attached to the tether at the position which is proximate the floor when the tether extends from the mounting means, holding means connected to the mounting means for releasably holding the light at the mounting means under normal conditions and for releasing the light from the mounting means upon occurrence of an emergency signal from the emergency signal generator, whereby the light drops into the relatively smoke free space upon the occurrence of the emergency condition so that the light is not concealed by smoke accumulated from the ceiling of the enclosure down to the relatively smoke free level.

2. The system of claim 1 wherein the holding means includes electromagnetic means, a power source for the electromagnetic means and means connected between the power source and electomagnetic means for interrupting current flowing between the power source and electromagnetic means to deenergize the electromagnet upon the occurrence of an emergency signal.

3. The system of claim 2 further including means for energizing the light only upon the occurrence of an emergency condition.

4. The system of claim 3 wherein the means for energizing the light includes battery means connected to the light through switching means and means for operating the switching means when the light drops from the mounting means.

5. The system of claim 4 wherein the light is a strobe light.

6. The system of claim 4 further including means for raising automatically the light back to the position adjacent to the mounting means upon termination of the emergency signal.

7. The system of claim 6 wherein the detecting means is a smoke detector which is connected to the current interrupting means for interrupting power to the mounting means upon generation of an emergency condition signal by the smoke detector.

8. The system of claim 1 wherein the light is a strobe light.

9. The system of claim 1 wherein the detecting means is a smoke detector which is connected to the current interrupting means for interrupting power to the mounting means upon generation of an emergency condition signal by the smoke detector.

* * * * *